US005954218A

United States Patent [19]

Starr

[11] Patent Number: 5,954,218

[45] Date of Patent: Sep. 21, 1999

[54] OPEN HEAD CONTAINER COVER

[76] Inventor: Robert J. Starr, R.D. #3, Box 353, Tyrone, Pa. 16686

[21] Appl. No.: 08/593,070

[22] Filed: Jan. 29, 1996

[51] Int. Cl.[6] ..... B61D 39/00

[52] U.S. Cl. ..... 220/254; 220/324

[58] Field of Search ..... 220/254, 324, 220/344

[56] References Cited

U.S. PATENT DOCUMENTS

| | | | |
|---|---|---|---|
| 1,002,333 | 9/1911 | Stollberg . | |
| 1,009,842 | 11/1911 | Jones . | |
| 1,126,640 | 1/1915 | Jones . | |
| 1,948,263 | 2/1934 | Green | 220/324 |
| 1,977,935 | 10/1934 | Caldwell . | |
| 2,764,200 | 9/1956 | Gits . | |
| 2,765,948 | 10/1956 | Paley et al. . | |
| 3,045,857 | 7/1962 | Lineweber | 220/321 X |
| 4,293,079 | 10/1981 | Lytle . | |
| 4,411,371 | 10/1983 | Collier et al. | 220/324 X |
| 4,545,502 | 10/1985 | Reuter . | |
| 4,570,816 | 2/1986 | Ferris et al. | 220/324 X |
| 4,982,864 | 1/1991 | Kusta | 220/320 |
| 5,402,835 | 4/1995 | Middleton . | |
| 5,438,935 | 8/1995 | Seitz | 220/324 X |

FOREIGN PATENT DOCUMENTS

| | | |
|---|---|---|
| 146730 | 4/1931 | Switzerland . |

*Primary Examiner*—Steven Pollard

[57] ABSTRACT

A cover for an open head hazardous waste container. The open head container is of the type having a container body that is constructed of elongated side walls and an end wall which border and define a container body cavity. The open head container further being of the type in which the cover is secured to the container body by a bolt ring that is secured around the cover and the container body. The cover has a housing with a passage provided therethrough. The housing also has a sealing portion that is sealably engageable to the container such that the housing passage is connected to the container body cavity. A hinge is then provided upon the housing, and a lid is movably connected to the hinge. The lid is sealable with the housing, and movable about the hinge through open and closed positions. When the lid is in the open position, the housing passage is uncovered. When the lid is in the closed position, the lid is in sealed engagement with the housing. A lock is used to secure the lid into air-tight engagement with the housing. The lock is preferably one or more clamps provided around the lid at the housing first end. A first gasket is provided between the housing and the container body. A second gasket is provided between the lid and around the housing opening.

17 Claims, 5 Drawing Sheets

OPEN HEAD CONTAINER COVER

BACKGROUND OF THE INVENTION

1. Field of the Invention

This invention relates to covers for drums or vertical containers holding hazardous waste materials which are to be prevented from escaping into the environment, such as waste oils. Still, more particularly, the invention relates to open head containers having a cover which may be sealably attached and detached to the container such as through the use of a sealable, hinged lid thereupon.

2. Description of the Prior Art

Drums used in the waste industry to contain and store potentially hazardous wastes, such as waste oils, are typically 55 gallon or 30 gallon drums. Two general types of containers are common in the hazardous waste industry. These two types are open head containers and closed head containers. Closed head containers have a nonremovable top with a relatively small opening in that top. Waste materials are able to be entered into the container through the small opening, usually through the use of some type of funnel. Open head containers are containers in which the cover is substantially the same width as the drum and may be attached and detached from the container.

Open head containers utilize a flat cover which mates to the drum. Unsealed lids can be used which sit on a drum and are thus easily removed. Such unsealed lids carry the risk that hazardous material will exit the drum. Thus, the industry utilizes covers for open head containers which may be sealably secured to the drum.

Sealably securing the cover to the drum is necessary because certain potentially hazardous wastes must be placed in sealed containers. For example, volatile organic compounds must often be placed in the containers. Thus, the waste container must have a top which can be sealed to the drum in order to prevent the volatile organic compounds from exiting the container and entering the environment. Typically, the cover is secured to the drum by means of a bolt ring. In operation, the bolt ring is placed around the cover and the drum. Then, bolts are engaged with the bolt ring so as to tighten down the bolt ring around the cover and the drum.

In addition to being sealable, the cover must be removable, because materials often must be added to the drums at incremental stages. With covers currently available for use with open head containers, it is difficult to know if a proper seal has been attained. In an effort to make the sealing of the drum easier, devices such as rams have been employed, which press the bolt ring to the drum. The more often a cover is removed and resecured to a drum, the more likely that an improper seal will exist between the cover and the drum. In any event, removing the entire cover and resecuring it with a bolt ring is relatively time consuming.

Therefore, it would be advantageous to provide a cover that may be sealed to the waste container and remain sealed throughout the period in which materials are added to the drum. It would be further advantageous for such a drum to be capable of being opened and closed easily so as to allow materials to be added to the drum when necessary.

SUMMARY OF THE INVENTION

A cover for an open head hazardous waste container is provided which replaces the flat cover previously used in the industry. The cover of the present invention is sealed to the waste container easily through standard means, but also has a portion which may be opened and closed so that materials may be added to the drum without the cover being removed from the drum each time materials are added to the drum. Thus, the present invention provides a drum cover which allows waste materials to be incrementally added to the drum quickly and easily and without having to unsecure and resecure the cover to the drum by means of a bolt ring.

The open head container with which the cover of the invention is used is of the type having a container body, i.e., a drum, that is constructed of elongated side walls and an end wall which border and define a container body cavity. The container cavity opens at a container opening located at a second end of the side walls. The open head container is further of the type in which the cover is secured to the container body by a bolt ring that is secured around the cover and the container body.

The cover of the present invention has a housing, in which a passage is provided through the housing. The passage opens at a first end of the housing and opens at a second end of the housing. The housing also has a sealing portion that is sealably engageable to th e second end of the drum side walls such that the housing passage is connected to the container body cavity. Although the drums with which the cover is used are typically cylindrical, thus having a circular cross section, the cover may be used with drums having any cross sectional shape.

A hinge is then provided upon the housing, and a lid is movably connected to the hinge. The lid is sealable with the housing first end and a gasket is preferably provided between the lid and the housing first end, around the housing first end opening. The lid is movable about the hinge through open and closed positions relative to the housing first end. When the lid is in the open position, the housing first end opening is uncovered. When the lid is in the closed position, the lid is in sealed engagement with the housing first end.

A lock is used to secure the lid into air-tight engagement with the housing first end. The lock is preferably one or more clamps provided around the lid at the housing first end. The sealing portion of the housing is preferably a ledge connected to the housing. A gasket is then provided between the ledge and the second end of the container body side walls and around the container opening.

The housing of the cover may further have an interior lip. The lip is preferably annular and is configured and located such that a mesh screen placed inside the housing may be supported upon the lip.

Other objects and advantages of-the invention will become apparent from a description of certain present preferred embodiments thereof shown in the drawings.

DESCRIPTION OF THE PREFERRED EMBODIMENT

Figure 1:
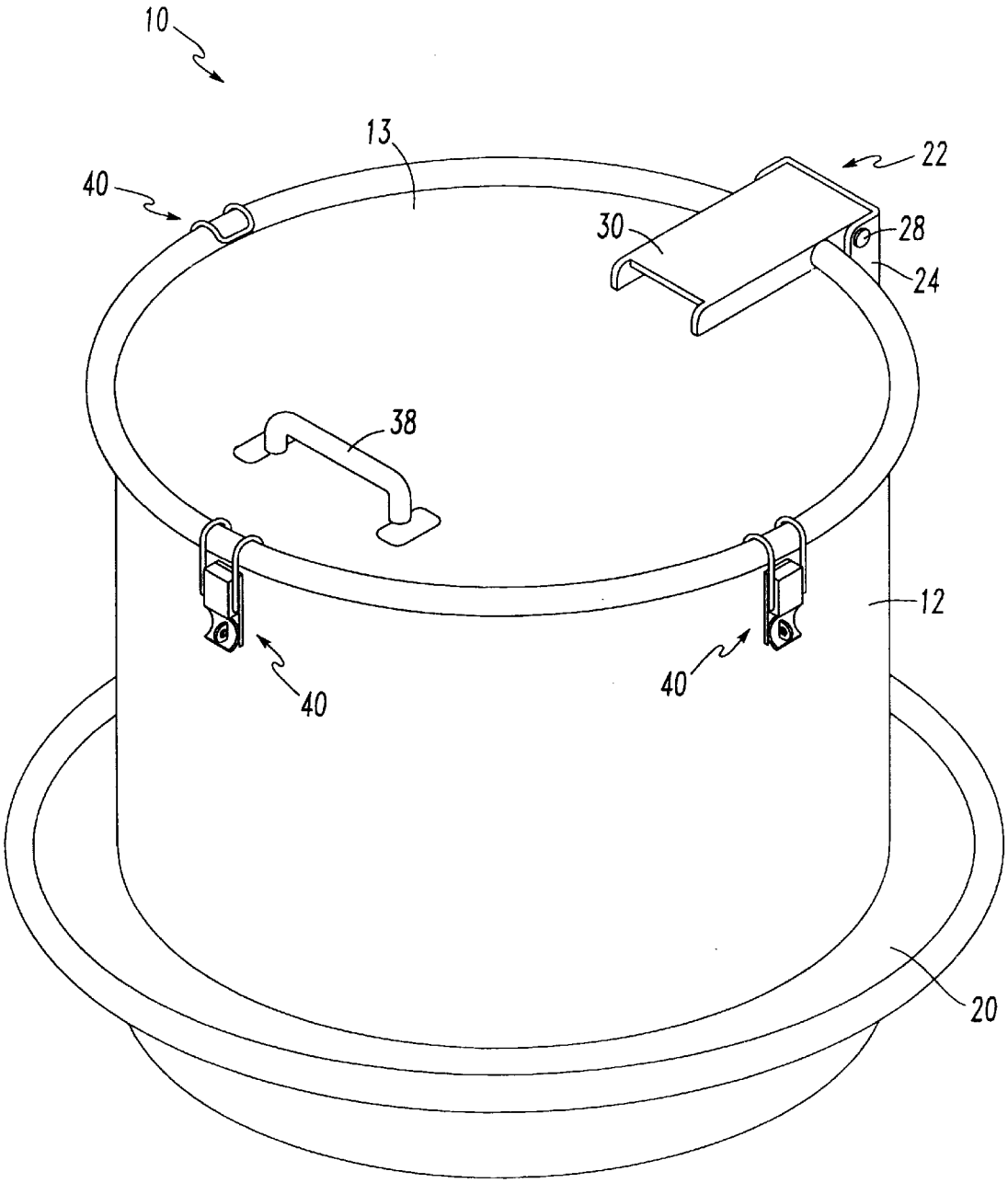
FIG. 1 is a perspective view of the preferred cover.
Figure 2:
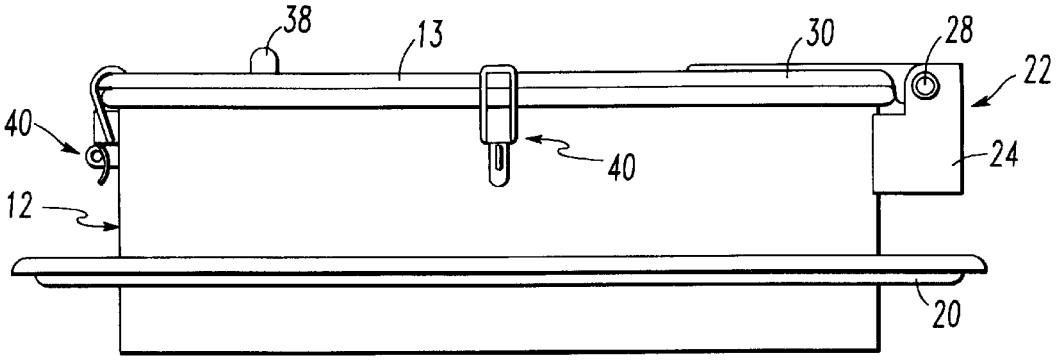
FIG. 2 is a front elevational view of the preferred cover.

Referring first to FIGS. 1 through 4, a cover 10 for an open head hazardous waste container 50 is shown. The cover 10 of the present invention replaces the flat cover previously used in the industry. The cover 10 of the present invention has as its main components a housing 12 and a lid 13. The housing 12 of the cover 10 is sealed to the container 50 and the lid 13 is movably connected to the housing 12. Both the housing 12 and the lid 13 are preferably fabricated of steel.

The housing 12 of the cover 10 is hollow so that a passage 14 is provided through the housing 12. As can be seen best in FIG. 4, the passage 14 through housing 12 opens at opposed ends of the housing 12 so as to open at a first end 16 and a second end 18 of the housing 12. The housing 12 connects to the container 50, preferably through a sealing portion 20. Sealing portion 20 sealably engages the housing 12 to the drum 50, as described in greater detail below.

The open head container 50, with which the cover 10 of the invention is used is of the type commonly used in the industry. Such containers 50 (also called "drums") are typically constructed of elongated side walls 52 and an end wall 54 (i.e., a bottom) that is located at a first end 56 of the drum 50. The side walls 52 and the end wall 54 border and define a container body cavity 55. The container cavity 55 opens at a second end 58 of the drum 50. It is within container cavity 55 that the waste materials are contained. Such drums 50 usually have a 55 gallon or 30 gallon capacity and are typically made of steel.

The open head container 50 is further of the type in which the cover 10 is secured to the container 50 by a bolt ring 60 that is secured around the cover 10 and the container body 50. The operation of the bolt ring 60, as such is used in the present invention, will be described in greater detail below.

Figure 3:
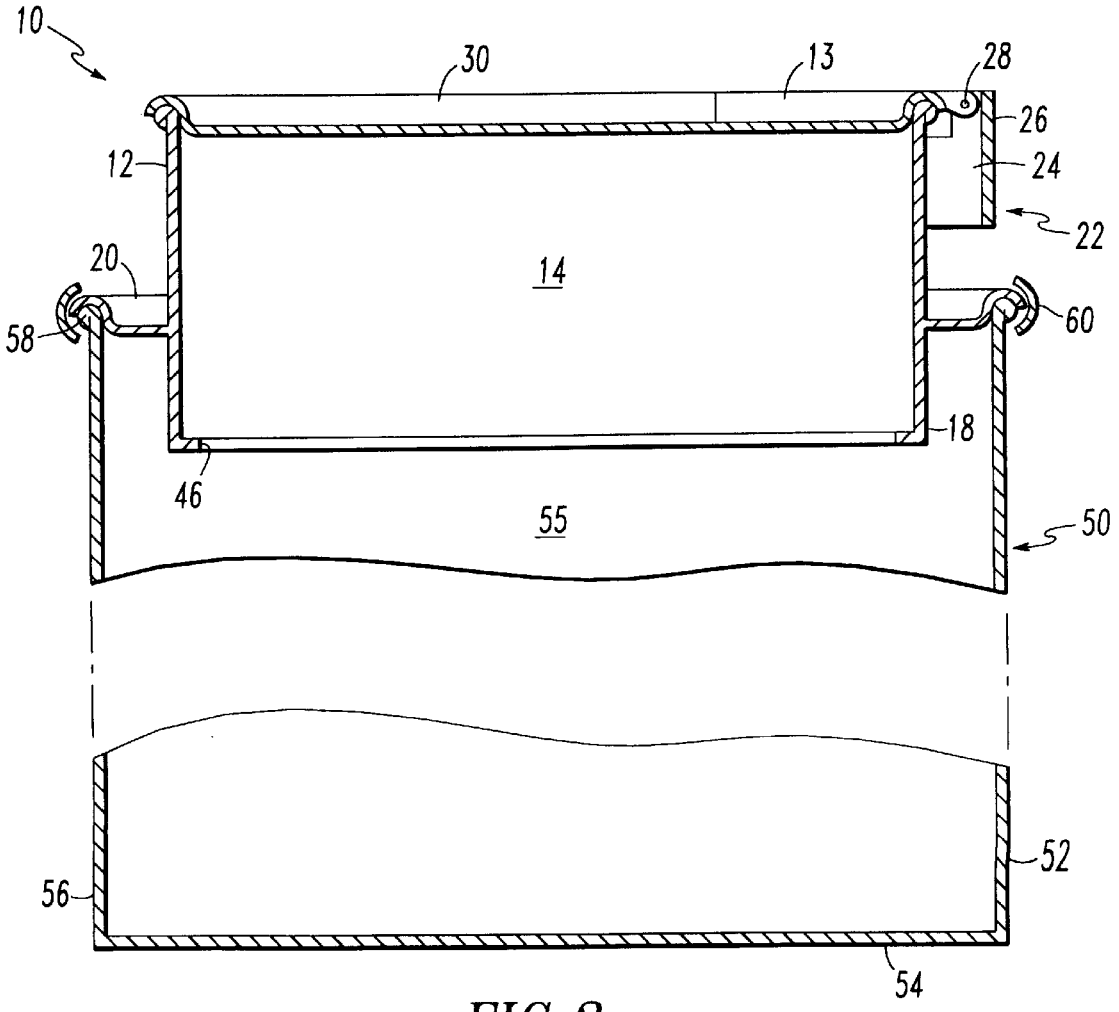
FIG. 3 is a front elevational view taken in cross section of the preferred cover secured to a drum and in the closed position.
Figure 4:
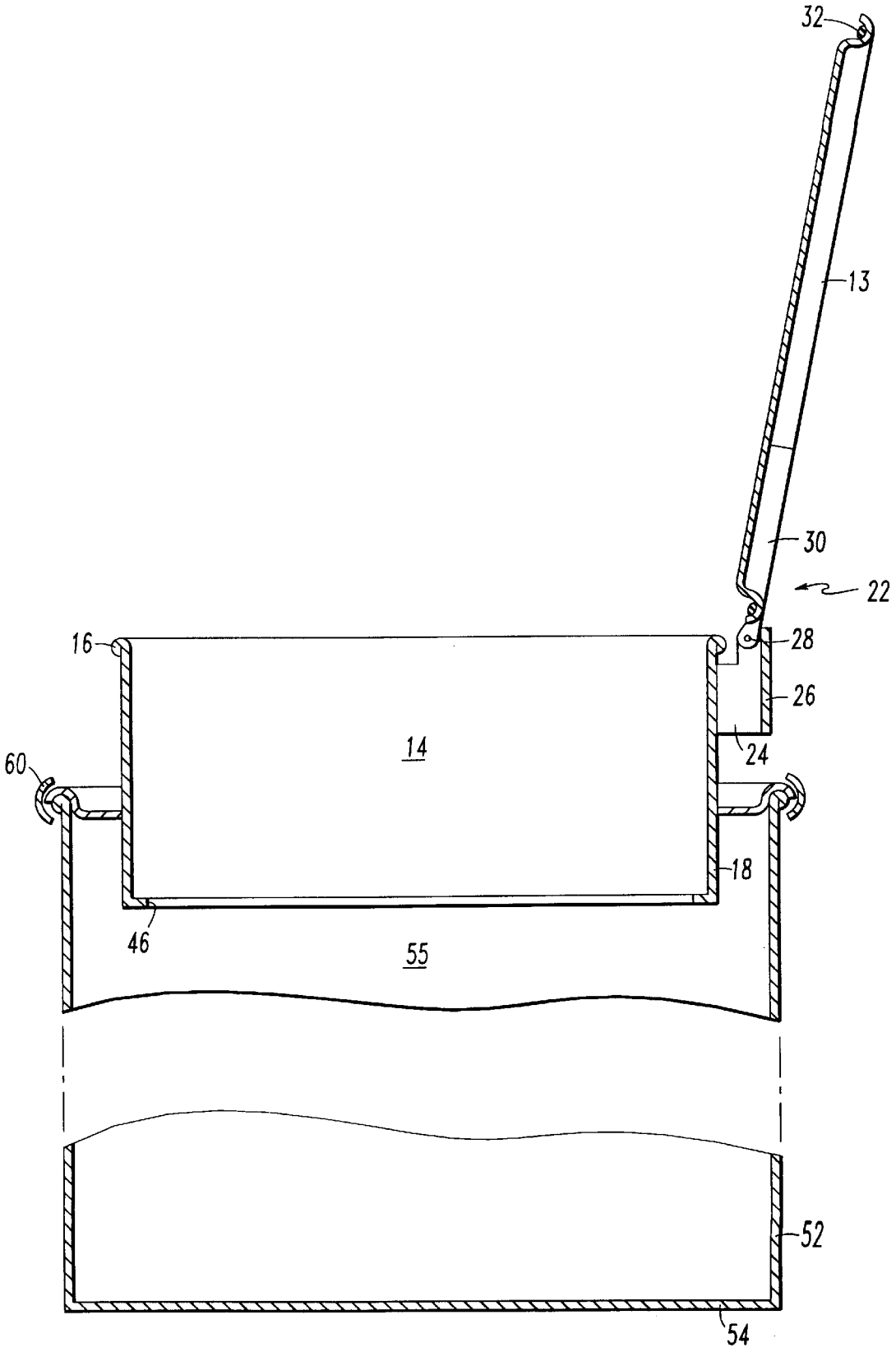
FIG. 4 is a front elevational view taken in cross section of the preferred cover secured to a drum and in the open position.
Figure 5:
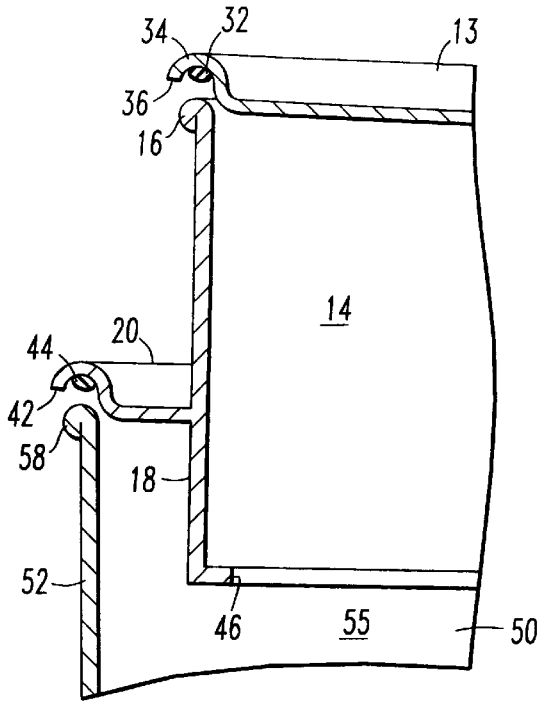
FIG. 5 is an elevational view taken in cross section of a portion of the preferred cover and a drum.

Referring next to FIGS. 3, 4 and 5, the manner in which the cover 10 is sealably secured to the drum 50 as well as the manner in which the lid 13 of the cover 10 is opened and sealably closed will be discussed. As can be seen best in FIG. 5, the drum 50 has side walls 52 which terminate at a second end 58. The second end 58 of the drum 50 is open so that drum cavity 55 is accessible from the second end 58 of the drum 50. The distal portion of the second end 58 of the drum 50 is preferably rounded. The second end 58 of the drum 50 may be rounded by any convenient means such as by rolling over the distal portion of the drum side walls 52.

The housing 12 of the cover 10 has an annular sealing portion 20 which sealably engages the housing 12 to the drum 50. The sealing portion 20 may be integral with the housing 12 or may be fabricated as a separate part or combination of parts that are attached to the housing 12. The sealing portion 20 may be affixed to the housing 12 by any convenient means, such as, for example, by being welded to the housing 12. The sealing portion 20 of the housing 12 is preferably made of steel.

The sealing portion 20 (shown in FIG. 5 in an unengaged position relative to the drum 50) preferably has a curved annular seat 42. A gasket is then preferably provided upon the curved seat 42 of the sealing portion 20. The gasket 44 is preferably made of a resilient material that can withstand contact with the particular material stored in the drum 50 without such gasket material deteriorating. It has been found that neoprene is an effective gasket material for many materials are stored within the drum 50. The gasket 44 may be secured within the curved seat 42 of the sealing portion 20 by any convenient means such as by use of an adhesive (not shown). The adhesive used for affixing the gasket 44 to the housing curved seat 42 should be one selected to withstand prolonged contact with the material provided within the drum 50. Preferably, gasket 44 is annular and continuous.

Sealing portion 20 may then be moved into engagement with the second end 58 of the drum 50 (shown best in FIGS. 3 and 4). When sealing portion 20 is in such an engaged position with the second end 58 of the drum 50, the gasket 44 will be held in close engagement between the curved seat 42 of the sealing portion 20 and the rounded second end 58 of the drum 50. The gasket 44 is preferably resilient so that it will deform somewhat when compressed between the sealing portion curved seat 42 and the second end 58 of the drum 50. The gasket will thus provide an air tight and water tight seal between the cover housing 12 and the drum 50.

Figure 6:
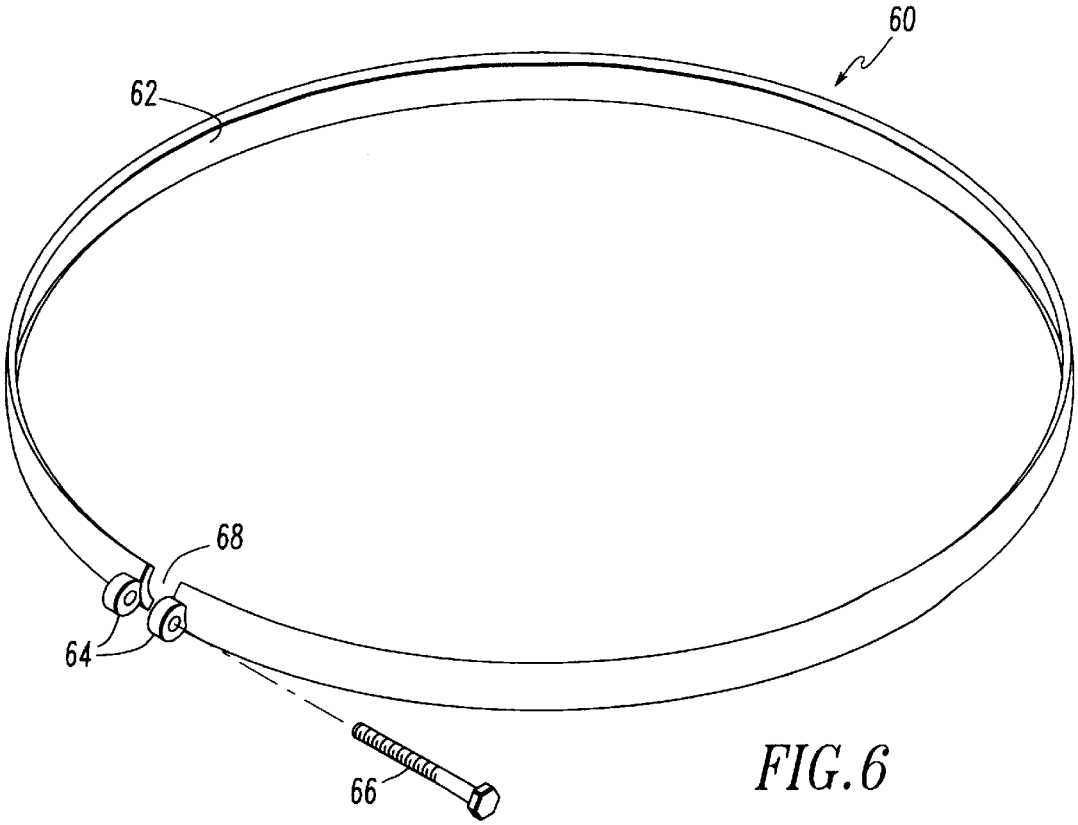
FIG. 6 is a perspective view of a bolt ring for securing the preferred cover to a drum.

Referring next to FIGS. 3, 4 and 6, once the housing 12 is in a sealed position relative to the drum 50, a bolt ring 60 is utilized to maintain the housing 12 and he drum 50 in such sealed position. The bolt ring 60 is of the type commonly used and generally known in the industry. The bolt ring 60 is preferably annular and has a curved inner surface 62. The bolt ring 60 and the curved inner surface 62 of the bolt ring 60 are sized and configured so that when placed around the housing sealing portion 20 and the drum second end 58 (shown best in FIGS. 3 and 4), the curved inner surface 62 of the bolt ring 60 will hold the sealing portion 20 into sealed engagement with the drum second end 58. The bolt ring 60 maintains the compression of the curved seat 42 of the sealing portion 20 and the rounded second end 58 of the drum 50, thus maintaining an air tight and water tight seal between the cover housing 12 and the drum 50.

Referring particularly to FIG. 6, the bolt ring 60 preferably has a separation 68 provided upon it so that the bolt ring 60 can be placed around the sealing portion 20 and the drum second end 58. Located along the bolt ring 60 along either side of the separation 68 and proximate to one another, are securing means 64. Securing means 64 of bolt ring 60 are preferably eyelets. In this way, a bolt 66 may be provided through both eyelets 64 and tightened down with a nut so as to close the separation 68, thus tightening the bolt ring 60 around the sealing portion 20 and the drum second end 58. With the bolt ring 60 thus tightened down, the housing 20 is held in air tight and water tight relation to the drum 50.

Thus, the cover 10 of the present invention is sealed to the waste container 50 easily through standard means (i.e., through a bolt ring 60 being secured around the cover 10 and drum 50). However, the cover 10 of the present invention also has a lid 13 which may be opened and closed so that materials may be added to the drum 50 without the cover 10 being removed from the drum 50. Therefore, the present container cover 10 allows waste materials to be incrementally added to the drum 50 quickly and easily and without having to unsecure and resecure the cover 10 to the drum 50 by means of a bolt ring 60 each time materials are added to the drum 50.

Referring again to FIGS. 3, 4 and 5, the operation of the lid 13 will now be described. Lid 13 preferably has an annular lip 34 provided around the outer periphery of the lid 13. The annular lip 34 preferably has a curved seat 36. A gasket 32 is then provided upon the curved seat 36. Preferably, gasket 32 is affixed to the curved seat 36 of the annular lip 34 such as through the use of an adhesive. The materials from which both the gasket 32 and the adhesive (not shown) are fabricated are selected so as to be compatible with the particular materials stored in drum 50 (i.e., to not deteriorate when in contact with such materials).

Preferably, gasket 32 is annular and is continuous. The gasket 32 is further preferably made of a resilient material.

As will be described in greater detail below, a hinge 22 movably connects lid 13- to the housing 12. The lid 13 is movable about the hinge 22 through open and closed positions relative to the housing 12. When the lid 13 is moved away from contact with housing 12, the lid is said to be in an open position as shown in FIG. 4. When the lid 13 is in such an open position, drum cavity 55 is accessible by way of housing cavity 14.

When the lid 13 is moved about hinge 22 toward housing 12, lid 13 is said to be in a closed position as shown in FIG. 3. When the lid 13 is in the closed position, the lid 13 is in sealed engagement with the housing 12 so that the housing passage 14 is inaccessible. When lid 13 is moved into the closed position, gasket 32 is compressed between the curved seat 36 of the annular lip 34 and the first end 16 of the housing 12. The first end 16 of the housing 12 is preferably rounded. The housing first end 16 may be rounded by any convenient means such as by rolling over the end of the housing 12. When the gasket 32 is held between the curved seat 36 and the rounded first end 16 of the housing 12, gasket 32 will compress. The gasket 32 being compressed between the curved seat 36 of the annular lip 34 and the rounded first end 16 of the housing 12 creates an air tight and water tight seal between the lid 13 and the housing 12.

Referring again to FIGS. 1, 2, 3 and 4, the hinge 22 will now be described. The hinge 22 operatively connects the lid 13 to the housing 12, so that the lid 13 is movably connected to the housing 12. The hinge 22 may be constructed in any convenient fashion to allow relative movement between the lid 13 and the housing 12. The components of the hinge 22 are preferably fabricated of steel. The hinge 22 preferably has a lid portion 30 which is connected to the lid 13. The lid portion 30 of the hinge 22 may be connected to the lid 13 by any convenient means, such as by being welded to the lid 13 or by being integral with the lid 13. The hinge 22 further preferably has a housing portion 24 which is affixed to the housing 12. The hinge housing portion 24 may also be connected to the housing 12 by any convenient means, such as by being welded to the housing 12 or by being integral with the housing 12.

The housing portion 24 of the hinge 22 further preferably has a rear wall 26. A hinge pin 28 is then disposed through the hinge housing portion 24 and the hinge lid portion 30 so that the housing portion 24 and lid portion 30 of the hinge 22 may rotate about hinge pin 28 relative to one another. The hinge 22 is preferably sized and configured such that when the lid 13 is pivoted about the hinge 22 into the open position, as shown in FIG. 4, the lid portion 30 of the hinge 22 will eventually contact the rear wall 26 of the hinge housing portion 24. When the lid portion 30 of the hinge 22 contacts the rear wall 26 of the housing portion 24, the lid portion 30 of the hinge 22 and thus the lid 13 to which the lid portion 30 is affixed will be prevented from further rotating about the hinge pin 28.

The lid 13 and the hinge 22 are preferably sized and configured so that the curved seat 36 of the annular lip 34 is separated a selected distance from the first end 16 of the housing 12. This selected distance is chosen to be less than the thickness of the gasket 32. In this way, when the lid 13 is moved about hinge 22 into the closed position, the gasket 32 is compressed between the curved seat 36 of the annular lip 34 and the first end 16 of the housing 12.

Referring again to FIG. 1, a means for locking the lid 13 into air-tight engagement with the housing 12 is also provided. The locking means is preferably one or more clamps 40 which are affixed to the cover housing 12 and which are provided circumferentially around the housing first end 16. The clamps 40 are sized and configured to grasp the lid 13 along the annular lip 34 of the lid 13. The clamps 40, when engaged, hold the lid 13 such that gasket 32 is compressed between the curved seat 36 of the annular lip 34 and the curved first end 16 of the housing 12. The clamps 40 thus retain the lid 13 sealably in the closed position. Although any number of clamps 40 may be used, three clamps 40 are preferred.

Figure 7:
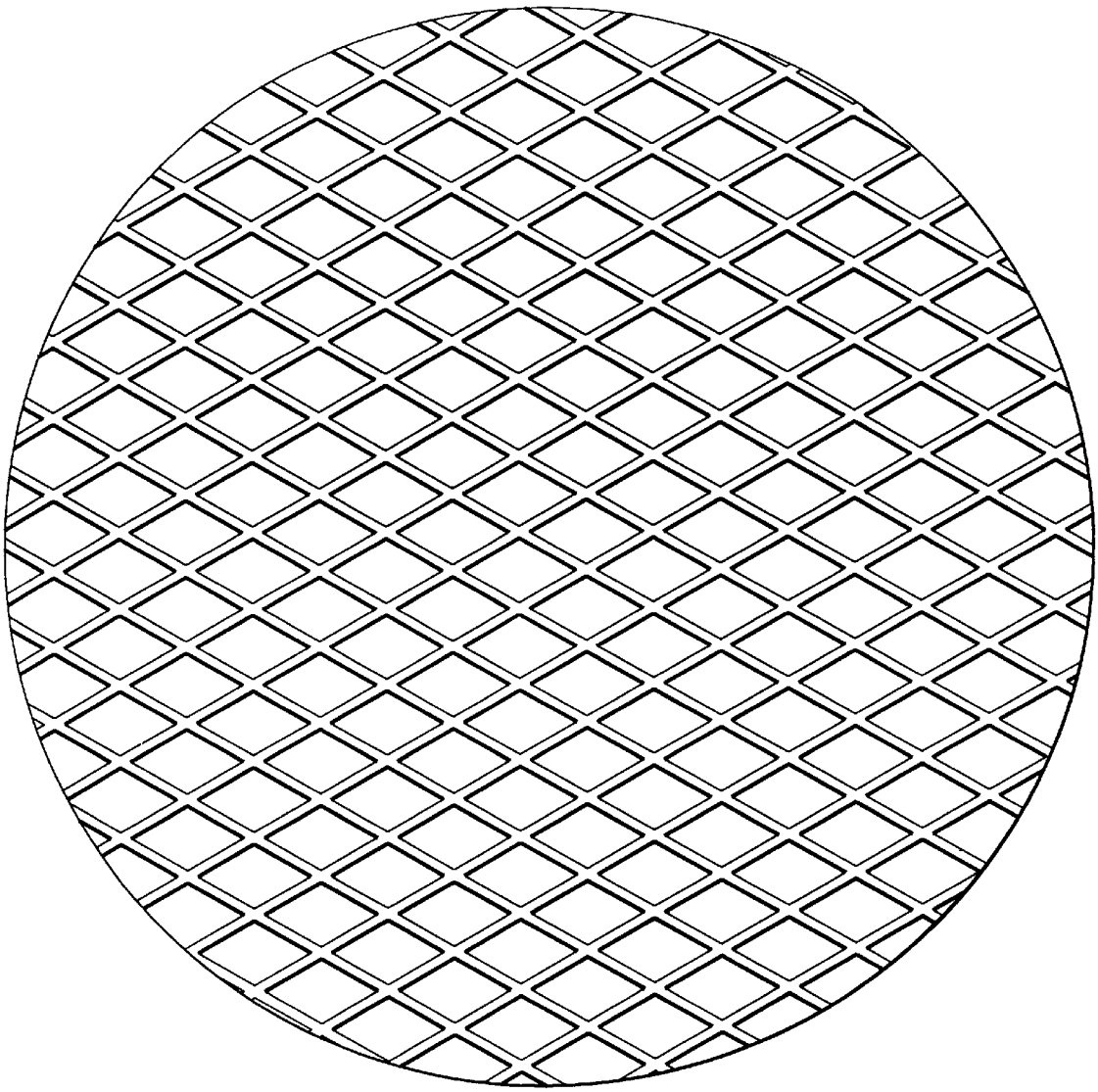
FIG. 7 is an elevational view of the mesh screen to be used with the preferred cover.

Provided along housing 12 preferably at a second end 18 of the housing 12 is an annular ledge 46. The ledge 46 is sized and configured such that a mesh screen 70, shown in FIG. 7, may be placed upon the ledge 46 and be supported thereupon. The ledge 46 is further configured and located so that the mesh screen 70 is provided within housing 12 when supported upon the ledge 46. The mesh screen 70 may thus act as a filter for the materials being entered into the drum 50 through the cover 10. The mesh screen 70 is preferably fabricated from a strong, durable material, such as steel.

Variations of the preferred embodiment may be made. For example, although the drums 50 with which the cover is used are typically cylindrical, thus having a circular cross section, the cover 10 may be used with drums 50 having any cross sectional shape in which the cover 10 is designed to have any cross sectional shape mating with any drum 50. Further, although the cover housing 12, the lid 13, the hinge 22 and the mesh screen 70 are preferably fabricated of steel, any suitable material may be used.

While certain present preferred embodiments have been shown and described, it is distinctly understood that the invention is not limited thereto but may be otherwise embodied within the scope of the following claims.

I claim:

1. A cover for a hazardous waste container wherein the hazardous waste container is a standard open head container having a container body constructed of elongated side walls which terminate in an end wall at a first end such that the elongated side walls and the end wall border and define a container body cavity which opens at a container opening at a second end of the elongated side walls; the hazardous waste container further having a cover on the container opening and a bolt ring is secured around the cover and the container body, thus securing the cover to the container body and sealing the container opening, the cover comprising:

a housing having a passage therethrough, in which the passage has an opening at a first end of the housing and an opening at a second end of the housing;

a sealing portion of said housing that is sealably engageable to the second end of the elongated side walls, such that the housing passage is removably connected to the container body cavity;

a hinge provided upon the housing;

a lid movably connected to the hinge and sealable with the housing first end, wherein the lid is movable about said hinge through an open position in which the housing first end is uncovered and is movable through a closed position in which the lid is in sealed engagement with the housing first end; and means for locking the lid into secure engagement with the housing first end.

2. The cover of claim 1 wherein the sealing portion of the housing is comprised of ledge connected to the housing.

3. The cover of claim 2 further comprising a gasket provided between the ledge and the second end of the container body side walls and around the container opening.

4. The cover of claim 2 wherein the sealing portion has a concave curved annular seat.

5. The cover of claim 4 wherein the second end of the container side walls engageable with the sealing portion is rounded so as to be convex.

6. The cover of claim 5 wherein the second end of the container side walls is rounded by rolling over a distal portion of the container side wall second end.

7. The cover of claim 5 wherein a gasket is provided upon the curved seat of the sealing portion such that when the sealing portion is engaged with the second end of the container side walls, the gasket will be held in close engagement between the curved seat of the sealing portion and the rounded second end of the drum side walls.

8. The cover of claim 1 wherein the lid has an annular lip provided around an outer periphery of the lid.

9. The cover of claim 8 wherein the annular lip has a concave curved seat.

10. The cover of claim 9 wherein the first end of the housing is rounded so as to be convex.

11. The cover of claim 10 wherein the housing first end is rounded by rolling over a distal end of the housing.

12. The cover of claim 10 wherein a gasket is provided upon the curved seat such that when the lid is engaged with the housing, the gasket is held between the curved seat and the rounded first end of the housing.

13. The cover of claim 1 wherein the hinge has a lid portion connected to the lid, a housing portion connected to the housing and a hinge pin disposed through the hinge housing portion and the hinge lid portion so that the housing portion and the lid portion may rotate about the hinge pin relative to one another.

14. The cover of claim 13 wherein the housing portion of the hinge has a rear wall, and wherein the hinge is sized and configured such that when the lid is pivoted about the hinge away from the housing, the lid portion of the hinge will contact the rear wall of the hinge housing portion such that the lid portion of the hinge will be prevented from further rotating about the hinge pin.

15. The cover of claim 1 wherein the means for locking the lid into secure engagement with the housing first end comprises at least one clamp affixed to the cover housing.

16. The cover of claim 15 wherein the clamps are sized and configured to grasp the lid along the annular lip of the lid.

17. The cover of claim 1 wherein an annular ledge is provided at the second end of the housing and wherein the ledge is sized and configured such that a mesh screen may be placed upon the ledge and be supported thereupon.

* * * * *

UNITED STATES PATENT AND TRADEMARK OFFICE

CERTIFICATE OF CORRECTION

PATENT NO. : 5,954,218

DATED : September 21, 1999

INVENTOR(S) : ROBERT J. STARR

It is certified that error appears in the above-indentified patent and that said Letters Patent is hereby corrected as shown below:

Item [73]

Please insert the following on the title page of the patent:

--[73] Assignee: New Pig Corporation, Tipton, PA--

Signed and Sealed this

Twenty-first Day of March, 2000

*Attest:*

*Attesting Officer*

Q. TODD DICKINSON

*Commissioner of Patents and Trademarks*